US005416379A

United States Patent [19]

Inoue et al.

[11] Patent Number: 5,416,379

[45] Date of Patent: May 16, 1995

[54] COLOR CATHODE-RAY TUBE

[75] Inventors: Masatsugu Inoue, Kumagaya, Japan; Takeshi Fujiwara, Dusseldorf, Germany

[73] Assignee: Kabushiki Kaisha Toshiba, Kawasaki, Japan

[21] Appl. No.: 196,533

[22] Filed: Feb. 15, 1994

[30] Foreign Application Priority Data

Feb. 16, 1993 [JP] Japan ..... 5-025885
Dec. 28, 1993 [JP] Japan ..... 5-335459

[51] Int. Cl.[6] ..... H01J 29/07

[52] U.S. Cl. ..... 313/402; 313/408; 313/477 R

[58] Field of Search ..... 313/402, 408, 403, 477 R; 220/2.1 A, 2.3 A

[56] References Cited

U.S. PATENT DOCUMENTS 4,636,683 1/1987 Tokita et al. ..... 313/408 X
4,677,339 6/1987 Inoue et al. ..... 313/402
4,697,119 9/1987 Inoue et al. ..... 313/408
4,839,556 6/1989 Ragland, Jr. ..... 313/408
4,881,004 11/1989 Inoue et al. ..... 313/408
4,943,754 7/1990 Hirai et al. ..... 313/408 X
5,155,410 10/1992 Wakasono et al. ..... 313/402

FOREIGN PATENT DOCUMENTS 304922 3/1989 European Pat. Off. .
19-3547 2/1944 Japan .
61-88427 5/1986 Japan .
61-163539 7/1986 Japan .
64-17360 1/1989 Japan .
1-154443 6/1989 Japan .
2147142 5/1985 United Kingdom .
2186422 8/1987 United Kingdom .

*Primary Examiner*—Donald J. Yusko
*Assistant Examiner*—Ashok Patel
*Attorney, Agent, or Firm*—Cushman Darby & Cushman

[57] ABSTRACT

A color cathode-ray tube includes a curved shadow mask formed having a number of apertures and a substantially rectangular effective surface facing the inner surface of the panel. The effective surface of the shadow mask has a center through which the tube axis passes, a horizontal axis passing through the center and at right angles to the tube axis, and a vertical axis extending and at right angles to the tube axis and the horizontal axis. The effective surface of the shadow mask is formed so that, in the region located on the horizontal axis, the radius of curvature in the direction of the horizontal axis of the surface is larger than the radius of curvature in the direction of the vertical axis of the surface in a region substantially halfway between the center of the surface and a horizontal end of the surface, and so that, in the region located on the horizontal axis, the horizontal radius of curvature is smaller than the vertical radius of curvature in a region near the horizontal end portion.

4 Claims, 2 Drawing Sheets

COLOR CATHODE-RAY TUBE

BACKGROUND OF THE INVENTION

1. Field of the Invention

The present invention relates to a color cathode-ray tube, and more particularly, to a color cathode-ray tube in which mislanding of beam attributable to thermal expansion of a shadow mask and impact is reduced by changing the configuration or curvature of the effective surface of the mask and/or the inner surface of an effective region of a panel.

2. Description Of The Related Art

In general, a color cathode-ray tube comprises a phosphor screen formed of three color phosphor layers and a shadow mask facing the screen. Three electron beams emitted from an electron gun are sorted by means of the shadow mask, and a color image is displayed on the phosphor screen.

The color cathode-ray tube comprises a rectangular panel having an effective area whose inner surface is formed essentially of a curved surface, and the phosphor screen is formed on the inner surface of the effective area. On the other hand, the shadow mask includes a mask body, which has a substantially rectangular effective surface, and a mask frame attached to the peripheral portion of the mask body. The effective area of the mask body is in the form of a curved surface corresponding to the inner surface of the panel in configuration and a number of electron beam apertures, through which the electron beams pass, are formed in this curved surface. The shadow mask is supported on the inside of the panel in a manner such that elastic support members, to which the mask frame is attached, are fitted and retained on stud pins on the panel.

In order to display a color image having good color purity on the phosphor screen, in the color cathode-ray tube constructed in this manner, the three electron beams passed through their corresponding apertures of the shadow mask must be landed exactly on the three color phosphor layers which constitute the phosphor screen. To attain this, the distance between the panel and the shadow mask, especially the distance (value q) between the inner surface of the effective area of the panel and the effective surface of the mask, should be kept within an allowable range.

Conventionally, however, the body of the shadow mask is formed of a thin carbon steel sheet, and the quantity of those electron beams which reach the phosphor screen after passing through the apertures in the effective surface of the mask body is not greater than one third of the quantity of the electron beams emitted from the electron gun, that is, most of the electron beams impinge on the mask. As a result, the shadow mask is heated to undergo thermal expansion, and the thin curved mask body, in particular, is subjected to doming such that it bulges toward the phosphor screen. If the height of the bulge attributable to the doming exceeds the allowable range of the value q, the electron beams land on the three color phosphor layers with a lag, thereby deteriorating color purity. This mislanding attributable to the thermal expansion of the shadow mask varies depending on the electric current of the electron beams, the size and duration of an image pattern, etc.

One such mislanding, attributable to the thermal expansion of the shadow mask, lasts for a relatively long period of time (30 minutes or more) before the temperature of the mask body, which, thinner than the mask frame, is heated in the initial stage of the operation of the color cathode-ray tube, is transmitted to the mask frame to establish a thermal equilibrium such that the respective temperatures of the mask frame and the mask body are substantially equal. This mislanding can be effectively corrected by interposing a bimetal element between the mask frame and elastic support members for supporting the shadow mask, as is described in Jpn. Pat. Appln. KOKOKU Publication No. 44-3547, for example. If a high-luminance image is locally displayed for a relatively short period of time, however, the shadow mask is subjected to a local thermal bulge, and the resulting local mislanding cannot be corrected by means of the bimetal element.

A rectangular pattern for the mislanding attributable to the thermal expansion of the shadow mask was drawn on the phosphor screen by means of a signal generator, and the size of the landing lag was measured varying the shape and originating position of the pattern. Thereupon, it was confirmed that the landing lag was small when a high-current, high-luminance rectangular pattern was formed substantially over the whole region of the phosphor screen. It was also ascertained that the greatest landing lag was caused when a high-current, high-luminance elongated rectangular pattern was formed converging a little from the left- or right-hand end (with respect to the horizontal axis or x-axis) of the phosphor screen.

These phenomena can be easily understood from the description to follow.

First, a TV set is generally designed so that an average anode current applied to the cathode-ray tube, that is, a current flowing through the anode for the whole picture, should not exceed a given value. When a large high-luminance rectangular pattern is formed on the phosphor screen in the aforesaid manner, therefore, the beam current for each unit area of the shadow mask is lower, and the temperature rise of the mask is smaller, than when the a small high-luminance rectangular pattern is formed.

Secondly, when a high-luminance pattern is formed on the central portion of the phosphor screen, a landing lag cannot be easily caused even though the shadow mask is subjected to thermal expansion. As the originating position of the pattern shifts from the center of the phosphor screen toward the left- and right-hand ends thereof, the thermal expansion of the shadow mask appears more frequently as a landing lag. At the opposite ends the screen, however, the body of the shadow mask is fixed by means of the mask frame, so that only a small deformation is caused by the thermal expansion. Thus, if a high-luminance pattern is formed converging a little from the left- or right-hand end of the phosphor screen, that is, if a region intermediate between the center and the horizontal end of the shadow mask, especially a region just outside the point halfway between the center and the horizontal end of the mask, is heated, then the mask undergoes a substantial thermal expansion, resulting in the greatest landing lag.

When the shadow mask is located in a normal position, an electron beam passing through one aperture which is situated a little nearer to the center of the mask than the horizontal end thereof lands exactly on its corresponding phosphor layer. If a high-luminance image is displayed by means of a high-current electron beam passing near the specific aperture, however, the shadow mask is subjected to thermal expansion in the vicinity of the aperture by impingement with the electron beam. This thermal expansion shifts the position of the electron beam aperture, so that the electron beam passing through this shifted aperture ceases to land on the specified phosphor layer.

In most of modern color cathode-ray tubes, in particular, the effective area of the panel is flat, so that the effective surface of the body of the shadow mask is also flat. Accordingly, the shadow mask is more easily deformed by thermal expansion due to the impingement with the electron beam, and a substantial landing lag is liable to be caused.

Disclosed in Jpn. Pat. Appln. KOKAI Publication Nos. 61-163539 and 61-88427 is means for restraining the mislanding by changing the configuration of a flat shadow mask. According to color cathode-ray tubes which combines a flat panel and a flat shadow mask, however, a satisfactory effect cannot be obtained from the configuration of the shadow mask described in these publications. Thus, in the modern color cathode-ray tubes, the panel and the shadow mask are flatter than the ones described in the above publications, and the landing lag attributable to thermal expansion of the mask by impingement electron beams is greater. In consequence, the landing lag cannot be fully corrected with use of the shadow mask configuration described in the aforesaid publications.

Disclosed in Jpn. Pat. Appln. KOKAI Publication Nos. 64-17360 and 1-154443 is means for restraining the landing lag attributable to thermal expansion of the shadow mask by changing the curvature of the panel. If the curvature of the panel is changed, as described in these publications, however, a satisfactory effect cannot be obtained for a substantially spherical flat panel which ensures a natural agreeable reflection on its outer surface, and has recently started to be used practically.

The color cathode-ray tube whose panel and shadow mask have flat effective surfaces involves the following problems, as well as the thermal expansion of the shadow mask.

In the color cathode-ray tube whose panel has a flat effective surface, the body of the shadow mask may be formed of a low-expansion material, such as Invar, besides a low-carbon steel sheet which is used for the shadow mask of a conventional color cathode-ray tube. Normally, the shadow mask body is press-molded to have a predetermined curved surface after apertures are formed therein by photo-etching. In this case, a large-curvature mask body can be subjected to appropriate plastic deformation to obtain a necessary mechanical strength as it is press-molded. However, a flat mask body cannot be subjected to satisfactory plastic deformation, and inevitably involves local low-strength portions. In other words, flattening the effective surface of the shadow mask results in reduction in the deformation and elongation of the mask during the press molding operation. Therefore, some portions of the shadow mask cannot be molded to a region for plastic deformation, remaining in a region for elastic deformation. In the case of a shadow mask which has a substantially rectangular effective surface, in particular, its short sides, which are situated at a distance in the direction of the horizontal axis from the center, are more distant from the center than its long sides, which are situated at a distance in the direction of the vertical axis from the center. Accordingly, those horizontal end portions of the mask which are situated a little nearer to the center than the short sides are the most fragile portions, which are deformed by impact or the like. Thus, the portions situated a little nearer to the center than the short sides, on the horizontal axis of the effective surface of the shadow mask, are distant from the center of the mask, and, unlike diagonal portions, are not surrounded by the skirt portion of the mask. Therefore, those horizontal end portions cannot undergo perfect plastic deformation during the press molding operation, and remain in the elastic deformation region. Consequently, they fail to be formed into previously designed curved surfaces, and their strength is lowered. Moreover, those portions easily resonate, causing a color drift.

SUMMARY OF THE INVENTION

The present invention has been contrived in order to solve these problems, and its object is to provide a color cathode-ray tube capable of preventing mislanding of the electron beam, which is attributable to thermal expansion of a shadow mask caused by impingement with electron beams, and deformation or resonance of the mask cannot be easily brought about by impact or vibration, even with use of a small-curvature flat shadow mask, let 10 alone a conventional shadow mask with a relatively large curvature.

In order to achieve the above object, a color cathode-ray tube according to the present invention comprises: a panel having a curved inner surface and a substantially rectangular effective area; a phosphor screen formed on the inner surface of the panel; and a curved shadow mask formed having a number of apertures and a substantially rectangular effective surface facing the inner surface of the panel. The effective surface of the shadow mask has a center through which the tube axis passes, a horizontal axis passing through the center and at right angles to the tube axis, and a vertical .axis extending through the center and at right angles to the tube axis and the horizontal axis.

At least one of the effective surface of the shadow mask and the inner surface of the effective area of the panel is formed so that, in the region located on the horizontal axis, the radius of curvature in the direction of the horizontal axis is larger than the radius of curvature in the direction of the vertical axis in a region substantially halfway between the center and a horizontal end of the surface, and so that, in the region located on the horizontal axis, the horizontal radius of curvature is smaller than the vertical radius of curvature in a region near the horizontal end portion.

In the effective area, a substantially spherical outer surface of the panel is formed so that there is a relation $d/S \leqq 0{,}041$, where d is the value of z of coordinates (x, y, z) at an end of the effective area along the diagonal axis of the outer surface of the panel, and S is the effective dimension of the effective area with respect to the direction of the diagonal axis, in a rectangular coordinate system having a Z-axis coincident with a tube axis extending through the center of the outer surface of the panel, an X-axis coincident with a horizontal axis extending through the center and at right angles to the tube axis, and a Y-axis coincident with a vertical axis extending through the center and at right angles to the tube axis and the horizontal axis, and that there are relationships $v<h<d$ and $2v<d<2h$, where h and v are values of z of coordinates at effective area ends along the X- and Y-axes, respectively.

If at least one of the effective surface of the shadow mask and the inner surface of the effective area of the panel is formed in this manner, thermal expansion of the mask attributable to impingement with electron beams can be restrained, and the mechanical strength of the mask is improved, so that deformation by impact and resonance can be reduced.

Thus, the radius of curvature of the shadow mask in the direction of the vertical axis thereof must be shortened in order to restrain the thermal expansion of the shadow mask. In particular, that region of the shadow mask which involves the problem of deterioration of color purity due to a high degree of thermal expansion lies substantially halfway between the center and the horizontal end of the effective surface of the mask. In order to improve the mechanical strength of the shadow mask, moreover, the mask must be subjected to perfect plastic deformation when it is press-molded. To attain this, the radius of curvature of the mask in the direction of the horizontal axis should be reduced. In particular, a low-strength region of the shadow mask is situated a little nearer to the center than the horizontal end.

Thus, by making the horizontal radius of curvature larger than the vertical radius of curvature in the region substantially halfway between the center and the horizontal end of the effective surface of the shadow mask, as in the present invention, the thermal expansion of the shadow mask attributable to the impingement with the electron beams in that region can be restrained effectively. Moreover, the mechanical strength of the shadow mask can be effectively improved to reduce deformation by impact and resonance by making the horizontal radius of curvature smaller than the vertical radius of curvature in the horizontal end portions of the effective surface of the mask.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

FIGS. 1 to 4 show a color cathode-ray tube according to an embodiment of the present invention, in which:

FIG. 1 is a longitudinal sectional view of the color cathode-ray tube,

FIG. 2 is a front view of a panel,

FIG. 3 is a perspective view of an effective area of the panel, and

FIG. 4 is a diagram showing the relationship between the horizontal and vertical curvature radii of an effective surface of the body of a shadow mask of the color cathode-ray tube in the vicinity of the horizontal axis of the mask.

DETAILED DESCRIPTION OF THE PREFERRED EMBODIMENT

A color cathode-ray tube according to an embodiment of the present invention will now be described in detail with reference to the accompanying drawings.

Figure 1:
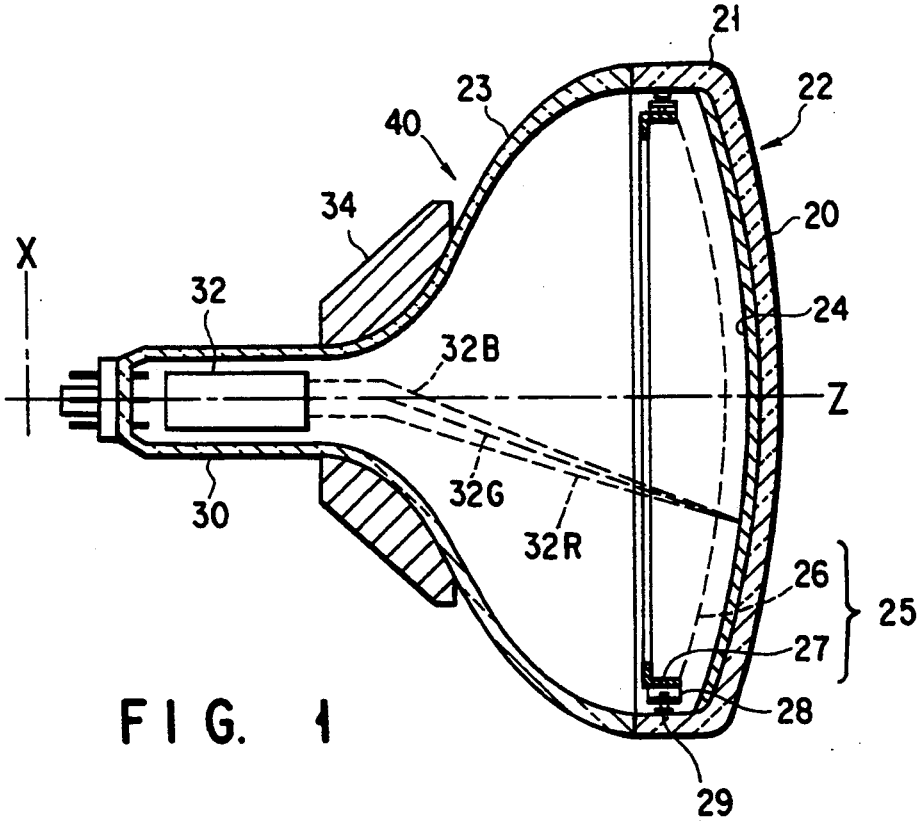
Figure 2:
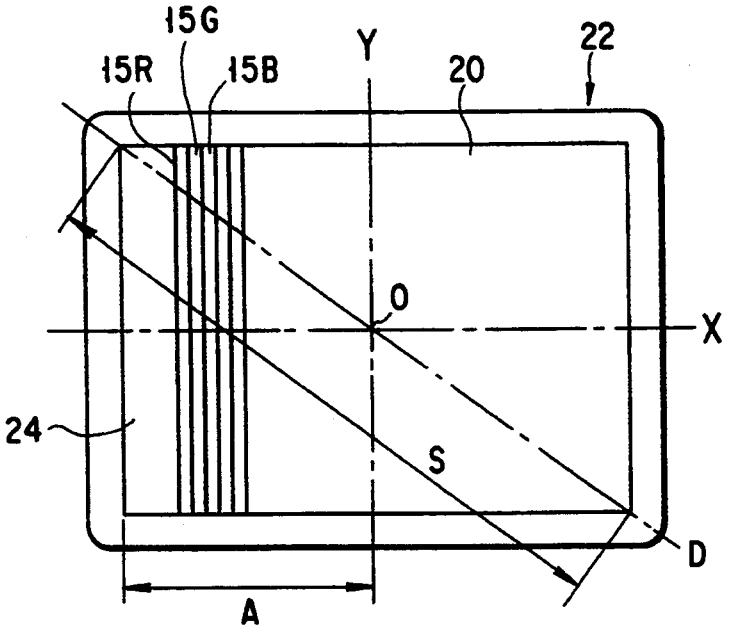

As shown in FIGS. 1 and 2, the color cathode-ray tube comprises an envelope 40 which includes a panel 22, having a substantially rectangular effective area 20 and a skirt portion 21 on the periphery of the effective area, and a funnel 23 bonded integrally to the skirt portion 21 of the panel 22. Formed on the curved inner surface of the effective area 20 is a phosphor screen 24 having three stripe-shaped color phosphor layers 15R, 15G and 15B which, arranged regularly, emit red, green, and blue light beams, respectively. The outer surface of the effective area 20 has the shape of a substantially spherical surface with a predetermined curvature (mentioned later) such that a reflected image on the outer surface externally looks natural without causing a sense of incompatibility. The inner surface of the area 20 has the shape of a nonspherical concave surface with a predetermined curvature (mentioned later).

A shadow mask 25 is located opposite the phosphor screen 24 in the envelope 40. The mask 25 includes a mask body 26, which has a substantially rectangular effective surface and a skirt portion on the periphery of the effective surface, and a mask frame 27 with an L-shaped section attached to the skirt portion of the body 26. The effective surface is a curved surface which is formed having a number of electron beam apertures. A plurality of elastic support members 28 are attached to the outer side face of the mask frame 27. The shadow mask 25 is mounted on the inside of the panel 22 in a manner such that fitting holes in the support members 28 are fitted and retained individually on a plurality of stud pins 29 on the inner surface of the skirt portion 21 of the panel 22.

Meanwhile, an electron gun 32 for emitting three aligned electron beams 32R, 32G and 32B is disposed in a neck 30 of the funnel 23. The three electron beams emitted from the gun 32 are deflected by means of a magnetic field which is generated by a deflecting coil 34 fitted on the outside of the funnel 23. The beams are sorted by means of the shadow mask 25 and used to scan the phosphor screen 24 horizontally and vertically, whereby a color image is displayed on the effective area 20 of the panel 22.

Figure 3:
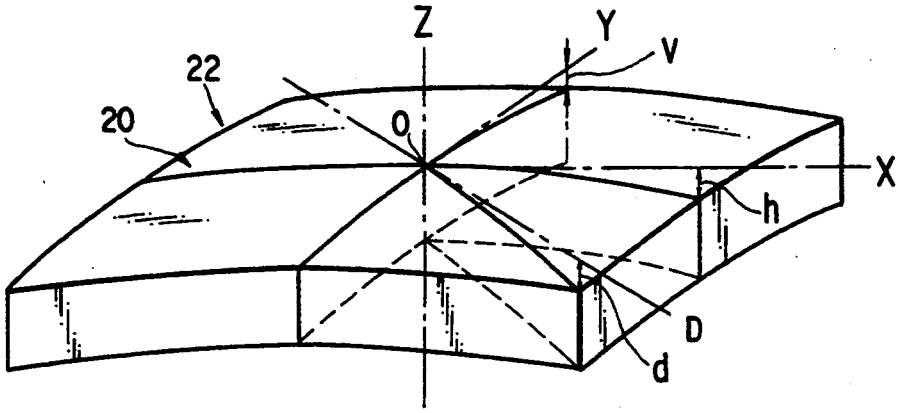

As shown in FIGS. 2 and 3, the flatness of the outer surface of the effective area 20 of the panel 22 is expressed as d/S, where d (mm) is the value of z (depression) of coordinates (x, y, z) at the axial end portion along a diagonal axis D of the area 20, and S (mm) is the effective dimension of the effective area with respect to the direction of the diagonal axis, in a rectangular coordinate system having a z-axis, X-axis (long axis), and Y-axis (short axis). The Z-axis is an axis which extends through the center 0 of the outer surface of the panel 22, and is coincident with the tube axis of the cathode-ray tube. The X-axis is a horizontal axis which extends through the center 0 and at right angles to the Z-axis. The Y-axis is a vertical axis which extends through the center 0 and at right angles to the Z-axis and the horizontal axis. In the present embodiment, the outer surface of the panel 22 is formed with $d/S \leqq 0.041$. Since the outer surface of the panel 22 is a substantially spherical surface, the outer surface of the effective area 20 is based on relationships given by $v<h<d$ and $2v<$- d<2h, where h and v (mm) are values of z (depressions) of coordinates at the axial end portions along the X- and Y-axes of the effective area 20, respectively.

In this arrangement, the outer surface of the panel 22 is flattened to a high degree, and a reflected image on the outer surface externally looks natural without causing a sense of incompatibility. The flat outer surface can improve the reading angle for the peripheral edge portion of the effective area 20, and further reduces the apparent distortion of a picture, which depends on the view angle, and the angle of reflection of external light, thereby providing a satisfactory image.

The degrees of flatness (d/S) of the outer surface of the panel 20 were compared between color cathode-ray tubes according to the present embodiment and conventional color cathode-ray tubes, having effective diagonal dimensions of 59 cm (25 inches), 68 cm (29 inches), and 80 cm (32 inches), individually. The result of the comparison is shown in the table below.

TABLE 1

| | 59 cm | 68 cm | 80 cm |
|---|---|---|---|
| Picture Tube of Invention | 0.037 | 0.036 | 0.041 |
| Prior Art Picture Tube | 0.048 | 0.054 | 0.063 |

When the present invention is applied to a recently developed wide cathode-ray tube in which the aspect ratio of the effective area 20 of the panel 22 is 16:9, the flatness of the outer surface of the panel is

TABLE 2

| | 56-cm (24 inch) Tube | 66-cm (28 inch) Tube | 76-cm (32 inch) Tube | 86-cm (36 inch) Tube |
|---|---|---|---|---|
| d/s | 0.038 | 0.037 | 0.038 | 0.041 |

These degrees of flatness are restricted depending on the strength of the cathode-ray tube. An agreeable picture can be enjoyed by adjusting the flatness of the outer surface of the panel to the values described above.

The curved effective surface of the mask body 26 is a nonspherical surface expressed by $$z = -\sum_{i=0}^{2}\sum_{j=0}^{2} A_{3j+j}X^{2j}Y^{2i}$$

where $A_{3i+j}$ is a coefficient and $A_0 = 0$, in the rectangular coordinate system of which the z-axis extends through the center of the effective surface and is coincident with the tube axis, the X-axis (long axis) is a horizontal axis which extends through the center and at right angles to the Z-axis, and the Y-axis (short axis) is a vertical axis which extends through the center and at right angles to the Z-axis and the horizontal axis.

Figure 4:
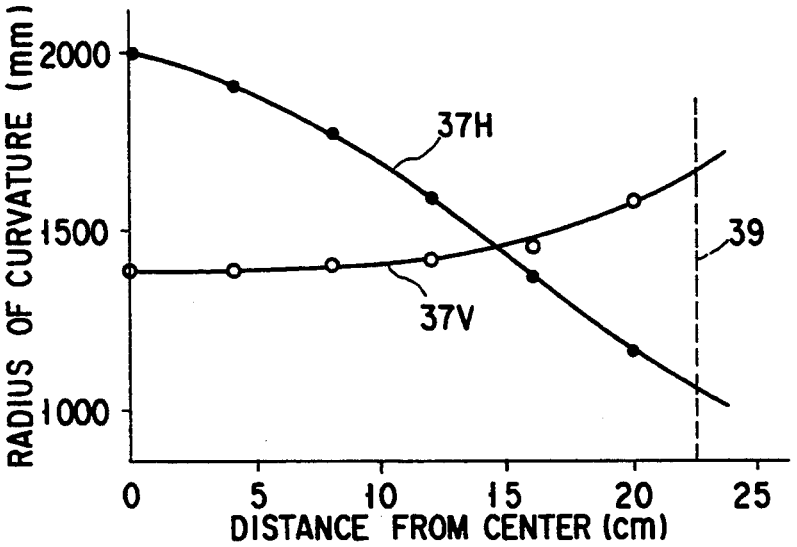
Figure 5:
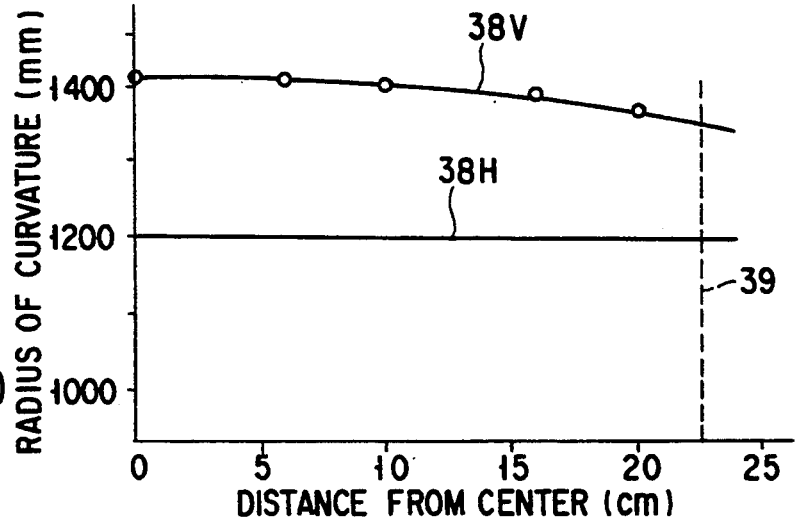
FIG. 5 (PRIOR ART)
FIG. 5 is a diagram showing the relationship between the horizontal and vertical curvature radii of an effective surface of the body of a conventional shadow mask in the vicinity of the horizontal axis thereof.

FIG. 4 shows the changes of the radius of curvature, at the region located on the horizontal axis, of the effective surface of the mask body 26 determined according to the above equation. In FIG. 4, a curve 37H represents the horizontal radius of curvature of the region located on the horizontal axis, and a curve 37V represents the vertical radius of curvature of the region on the horizontal axis. FIG. 5 illustrates the configuration of a conventional shadow mask for comparison. In FIG. 5, a curve 38H represents the horizontal radius of curvature of the region on the horizontal axis of the effective surface of the mask body, and a curve 38V represents the vertical radius of curvature of the region on the horizontal axis. A broken line 39 indicates the end of the effective surface with respect to the direction of the horizontal axis.

As seen from comparison between FIGS. 4 and 5, the shadow mask 25 according to the present embodiment is characterized in that the curves 37H and 37V cross each other so that the relation between the radii of curvature in the directions of the horizontal and vertical axes is reversed, at a point at a distance equal to about 65% of the distance A (see FIG. 1) between the center (effective surface center) of the mask body 26 and the end of the effective surface, from the center.

In the conventional shadow mask shown in FIG. 5, the vertical radius of curvature (curve 38V) of the portion on the horizontal axis is larger than the horizontal radius of curvature (curve 38H) throughout the area from the center of the mask body to the effective surface end. In the shadow mask 25 according to the present embodiment, in contrast with this, the horizontal radius of curvature (curve 37H) of the portion on the horizontal axis is larger than the vertical radius of curvature (curve 37V) on the side of the 10 center of the mask body 26. The relation between the curvature radii is reversed at the point at the distance equal to about 65% of the distance A from the center of the effective surface. Thus, on the side of the effective surface end, the horizontal radius of curvature is smaller than the vertical radius of curvature.

The flatness of the shadow mask 25 according to the present embodiment, with respect to the whole picture, is about 1.3 times as high as that of the conventional shadow mask shown in FIG. 3. Nevertheless, according to the shadow mask 25 of the present embodiment, the vertical radius of curvature (37V) in the middle portion of the horizontal axis is 1,400 mm, which is equivalent to the vertical radius of curvature (38V) for the conventional shadow mask. In the vicinity of the effective surface end with respect to the direction of the horizontal axis, the horizontal radius of curvature (37H) is 1,100 mm, which is smaller than the horizontal radius of curvature (38H) of the conventional shadow mask at 1,200 mm.

With the effective surface of the mask body 26 shaped in this manner, the thermal expansion of the mask, which used to be caused most frequently in a region substantially halfway between the center and the horizontal effective surface end of the mask body, by impingement with electron beams, can be effectively restrained by reducing the vertical radius of curvature of the middle region. Thus, dislocation of the apertures attributable to the thermal expansion of the shadow mask can be effectively restrained by reducing vertical radius of curvature of the effective surface.

Since the horizontal radius of curvature of the effective surface is reduced in the vicinity of the effective surface end with respect to the direction of the horizontal axis, moreover, the strength of that portion of the press-molded mask body which has the lowest mechanical strength can be improved, so that deformation by impact and color drift attributable to resonance can be restrained.

It is to be understood that the present invention is not limited to the embodiment described above, and that various changes and modifications may be effected therein by one skilled in the art without departing from the scope or spirit of the invention. In the shadow mask according to the above-described embodiment, for example, the relation between the horizontal and vertical radii of curvature of the region located on the horizontal axis of the effective surface is reversed at the point at the distance equal to about 65% of the distance A between the center of the mask body and the effective surface end, from the center in the horizontal direction. Thus, the vertical radius of curvature is smaller than the horizontal radius of curvature in the region ranging from the center of the mask body to the point at the distance equal to about 65% of the distance A. As in the case of the foregoing embodiment, however, the thermal expansion of the shadow mask attributable to the impingement with the electron beams can be restrained to reduce the mislanding by making the vertical radius of curvature of the mask near the horizontal axis smaller than the horizontal radius of curvature in the region ranging from the center of the mask body to a point at a distance equal to at least about 50% of the distance A.

The same effect of the foregoing embodiment can be ensured for the mechanical strength of the mask body by making the horizontal radius of curvature of the mask near the horizontal axis smaller than the vertical radius of curvature in each of the low-strength regions of the shadow mask, that is, in each region which extends from the horizontal end of the effective surface of the mask body for at least 20% of the distance A in the horizontal direction.

In the embodiment described above, moreover, the configuration of the curved effective surface of the body of the shadow mask is changed. In general, the configuration of the curved effective surface of the mask body is set in consideration of the distance between the inner surface of the panel and the mask body in addition to the configuration of the inner surface of the effective area of the panel. Thus, the curved effective surface configuration of the mask body according to the above-described embodiment may be also applied to the configuration of the inner surface of the effective area of the panel. Furthermore, both the inner surface of the effective area and the effective surface of the mask body should preferably be shaped as aforesaid.

Since the outer surface of the panel has a substantially spherical shape, the effective area of the panel is thinner in its middle portion than in the vicinity of its horizontal end portion if the inner surface of the effective area has the aforementioned curved configuration. A problem arises when a bulb of the color cathode-ray tube is broken in a manner such that the end portion of the effective area of the panel cracks and the whole effective area scatters forward. If the panel has the aforementioned thickness distribution, however, the middle portion of the effective area cracks more easily than the end portion thereof on the horizontal axis. Even when cracks are caused, therefore, there is no possibility of the panel scattering forward. Thus, the balance of the panel is improved so that the panel can be prevented from flying out when it is broken, and the panel weight can be reduced effectively.

According to the present invention, as described in detail herein, at least one of the effective surface of the substantially rectangular shadow mask and the inner surface of the effective area of the panel is formed so that, in the region near the horizontal axis, the radius of curvature in the direction of the horizontal axis is larger than the radius of curvature in the direction of the vertical axis in a region substantially halfway between the center and the horizontal end of the surface, or in a region a little nearer to the horizontal end than to the center, in particular, and so that, in the region near the horizontal axis, the horizontal radius of curvature is smaller than the vertical radius of curvature in a region near the horizontal end. In this arrangement, local thermal expansion of the shadow mask attributable to impingement with electron beams can be restrained to reduce the mislanding by only partially changing the configurations of the mask and the panel without any substantial modification. Also, deformation by impact and resonance can be effectively reduced by increasing the mechanical strength of the shadow mask. This arrangement produces a great effect when it is applied to a color cathode-ray tube whose panel and shadow mask are flat, in particular.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A color cathode-ray tube comprising:

a panel having a curved inner surface, a substantially spherical outer surface, and a substantially rectangular effective area, the outer surface of the panel in the effective area being formed so that there is a relation $d/S \leqq 0.041$, where d is the value of z of coordinates (x, y, z) at an end of the effective area along the diagonal axis of the outer surface of the panel, and S is the effective dimension of the effective area with respect to the direction of the diagonal axis, in a rectangular coordinate system having a Z-axis coincident with a tube axis extending through the center of the outer surface of the panel, an X-axis coincident with a horizontal axis extending through the center and at right angles to the tube axis, and a Y-axis coincident with a vertical axis extending through the center and at right angles to the tube axis and the horizontal axis, and that there are relationships $v<h<d$ and $2v<d<2h$, where h and v are values of z of coordinates at effective area ends along the X- and Y-axes, respectively;

a phosphor screen formed on the inner surface of the panel; and a curved shadow mask formed having a number of apertures through which electron beams pass and a substantially rectangular effective surface facing the inner surface of the panel, the effective surface of the shadow mask having a center through which the tube axis passes, a horizontal axis passing through the center and at right angles to the tube axis, and a vertical axis extending and at right angles to the tube axis and the horizontal axis, at least one of the effective surface of the shadow mask and the inner surface of the effective area of the panel being formed so that, in the region located on the horizontal axis, the radius of curvature in the direction of the horizontal axis is larger than the radius of curvature in the direction of the vertical axis in a region substantially halfway between the center and an axial end in the horizontal axis, and so that, in the region located on the horizontal axis, the horizontal radius of curvature is smaller than the vertical radius of curvature in a region near the axial end portion in the horizontal axis.

2. A color cathode-ray tube comprising:

a panel having a curved inner surface, a substantially spherical outer surface, and a substantially rectangular effective area, the outer surface of the panel in the effective area being formed so that there is a relation $d/S \leqq 0.041$, where d is the value of z of coordinates (x, y, z) at an end of the effective area along the diagonal axis of the outer surface of the panel, and S is the effective dimension of the effective area with respect to the direction of the diagonal axis, in a rectangular coordinate system having a Z-axis coincident with a tube axis extending through the center of the outer surface of the panel, an X-axis coincident with a horizontal axis extending through the center and at right angles to the tube axis, and a Y-axis coincident with a vertical axis extending through the center and at right angles to the tube axis and the horizontal axis, and that there are relationships $v<h<d$ and $2v<d<2h$, where h and v are values of z of coordinates at effective area ends along the x- and Y-axes, respectively;

a phosphor screen formed on the inner surface of the panel; and a curved shadow mask formed having a number of apertures through which electron beams pass and a substantially rectangular effective surface facing the inner surface of the panel, the effective surface of the shadow mask having a center through which the tube axis passes, a horizontal axis passing through the center and at right angles to the tube axis, and a vertical axis extending and at right angles to the tube axis and the horizontal axis, at least one of the effective surface of the shadow mask and the inner surface of the effective area of the panel being formed so that, in the region located on the horizontal axis, the radius of curvature in the direction of the horizontal axis is larger than the radius of curvature in the direction of the vertical axis in a region ranging from the center of the surface to a position at a distance a little longer than 50% of the distance between the center and the horizontal end from the center, and so that, in the region located on the horizontal axis, the horizontal radius of curvature is smaller than the vertical radius of curvature in a region near the horizontal end portion.

3. A color cathode-ray tube according to claim 2, wherein at least one the effective surface of said shadow mask and the inner surface of the effective area of said panel is formed so that the radius of curvature in the direction of the horizontal axis is larger than the radius of curvature in the direction of the vertical axis in a region ranging from the center of the surface to a position at a distance equal to 65% of the distance between the center and the horizontal end from the center along the horizontal axis.

4. A color cathode-ray tube comprising:

a panel having a curved inner surface and a substantially rectangular effective area;

a phosphor screen formed on the inner surface of the panel; and a curved shadow mask formed having a number of apertures through which electron beams pass and a substantially rectangular effective surface facing the inner surface of the panel, the effective surface of the shadow mask having a center through which the tube axis passes, a horizontal axis passing through the center and at right angles to the tube axis, and a vertical axis extending and at right angles to the tube axis and the horizontal axis, the effective surface of the shadow mask being formed so that, in the region located on the horizontal axis, the radius of curvature in the direction of the horizontal axis is larger than the radius of curvature in the direction of the vertical axis in a region ranging from the center of the surface to a position at a distance a little longer than 50% of the distance between the center and the horizontal end from the center, and so that, in the region located on the horizontal axis, the horizontal radius of curvature is smaller than the vertical radius of curvature in a region near the horizontal end portion.

* * * * *